US005251740A

United States Patent [19]

Spatafora et al.

[11] Patent Number: 5,251,740

[45] Date of Patent: Oct. 12, 1993

[54] COMPACTING UNIT FOR GROUPS OF FLAT PRODUCTS ARRANGED SIDE BY SIDE AND ON EDGE

[75] Inventors: Mario Spatafora; Giulio Strazzari, both of Bologna, Italy

[73] Assignee: Azionaria Construzioni Macchine Automatiche A.C.M.A. S.p.A., Bologna, Italy

[21] Appl. No.: 964,888

[22] Filed: Oct. 22, 1992

[30] Foreign Application Priority Data

Oct. 24, 1991 [IT] Italy ..... BO91 A 000396

[51] Int. Cl.[5] ..... B65G 47/26

[52] U.S. Cl. ..... 198/458; 198/434; 198/456

[58] Field of Search ..... 198/434, 456, 458

[56] References Cited

U.S. PATENT DOCUMENTS

| | | | |
|---|---|---|---|
| 2,526,983 | 10/1950 | Wait | 198/434 X |
| 3,990,572 | 11/1976 | Fishback | 198/458 |
| 4,800,704 | 1/1989 | Ishii et al. | 198/458 X |
| 4,834,605 | 5/1989 | Jerred | 198/434 X |
| 4,840,265 | 6/1989 | Sato et al. | 198/458 X |

*Primary Examiner*—Robert P. Olszewski
*Assistant Examiner*—Cheryl L. Gastineau
*Attorney, Agent, or Firm*—Oblon, Spivak, McClelland, Maier & Neustadt

[57] ABSTRACT

A unit for compacting groups of flat products arranged side by side and on edge, whereby a through conveyor feeds the groups, with the products separated axially, into successive engagement with a compacting device having a number of pairs of compacting elements on either side of the conveyor; the compacting elements in each pair traveling with the conveyor, being positioned facing the opposite ends of a respective group, and being brought together for transversely moving the products in the group into contact with one another.

7 Claims, 2 Drawing Sheets

COMPACTING UNIT FOR GROUPS OF FLAT PRODUCTS ARRANGED SIDE BY SIDE AND ON EDGE

BACKGROUND OF THE INVENTION

The present invention relates to a unit for compacting groups of flat products arranged side by side and on edge.

The present invention is especially suitable for use in the food industry, particularly for packing flat food products such as sweets, lozenges or similar, to which the following description refers purely by way of example.

Italian Patent Application N. 3621A/89 relates to a device for feeding flat products in controlled manner, whereby the products, e.g. cylindrical sweets, are fed flat and in random manner on a vibratory conveyor to a number of downward-curving channels, each of which rotates the products substantially 90° so that they are positioned on edge, and feeds them one at a time into respective pockets on a respective screw conveyor.

Each screw conveyor feeds the products transversely and unloads them successively and on edge on to an output conveyor extending beneath the output ends of the screw conveyors and comprising a conveyor belt with a series of transverse pockets, each designed to receive a group of products arranged side by side and on edge. The conveyor belt runs beneath a number of guide rods parallel to the traveling direction of the output conveyor, and each adjacent pair of which defines, along the output conveyor, a respective axial channel along which all the products fed on to the output conveyor by a given screw conveyor are fed successively. In other words, the screw conveyors are timed in relation to the output conveyor so as to feed a respective product into each pocket on the output conveyor, and the output ends of the screw conveyors are offset to enable each screw conveyor to feed the products into the same respective axial channel.

Downstream from the last screw conveyor, each pocket on the output conveyor thus houses a group of products arranged side by side and on edge, aligned perpendicular to the traveling direction of the output conveyor, and separated in said perpendicular direction by the guide rods in between.

SUMMARY OF THE INVENTION

It is an object of the present invention to provide a product compacting device featuring an input conveyor similar to the output conveyor described above, and which provides in a straightforward, reliable manner for producing a succession of compact groups of products, each consisting of a number of transversely-contacting products, for supply to a follow-up unit normally consisting of a wrapping line.

According to the present invention, there is provided a unit for compacting groups of flat products arranged side by side and on edge along a first axis perpendicular to the products; said unit comprising conveyor means for feeding said groups successively and in a given traveling direction perpendicular to said first axis, and a compacting device cooperating with said conveyor means; the conveyor means comprising a number of pocket means, each designed to receive a respective said group and feed it in said direction at a given speed, a first and second portion arranged in series in said traveling direction, and spacing means extending along said first portion for maintaining the products in each group separated along the first axis and achieving a first given axial dimension of the group greater than a second dimension equal to the total axial dimension of the relative products; characterized by the fact that the compacting device cooperates with said second portion, and comprises a number of pairs of compacting elements on either side of said second portion; drive means for moving each said pair of compacting elements along said second portion and substantially in time with a respective said pocket means; and guide means connected to the compacting elements in each said pair, for moving the compacting elements in relation to each other, and in opposite directions, between a first and second position wherein the compacting elements are separated by a distance respectively greater than said first axial dimension and substantially equal to said second axial dimension.

According to a preferred embodiment of the above unit, each compacting element comprises an arm mounted for rotation about a second axis facing said second portion and parallel to said first axis; and first pivot means extending transversely in relation to said first and second axis and rotating with said arm about the second axis; said guide means being connected to said arm for swinging it about said first pivot means and moving it between said first and second position.

Each said arm is preferably an articulated swing arm, and comprises a first and second portion, and second pivot means located between the first and second portion and extending transversely in relation to said first and second axis; said first portion being connected to both said first pivot means and said guide means, for swinging the arm about the first pivot means.

The compacting device preferably also comprises two supporting elements mounted for rotation about said second axis and located on either side of said conveyor means; each supporting element being fitted with a number of said pivot means, and being connected to said drive means so as to impart to the second portion of each respective swing arm a surface speed substantially equal to the traveling speed of said conveyor means.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Number 1 in the accompanying drawings indicates a unit for compacting groups 2 of flat products arranged side by side on edge and consisting in the example shown of cylindrical sweets 3.

Figure 1:
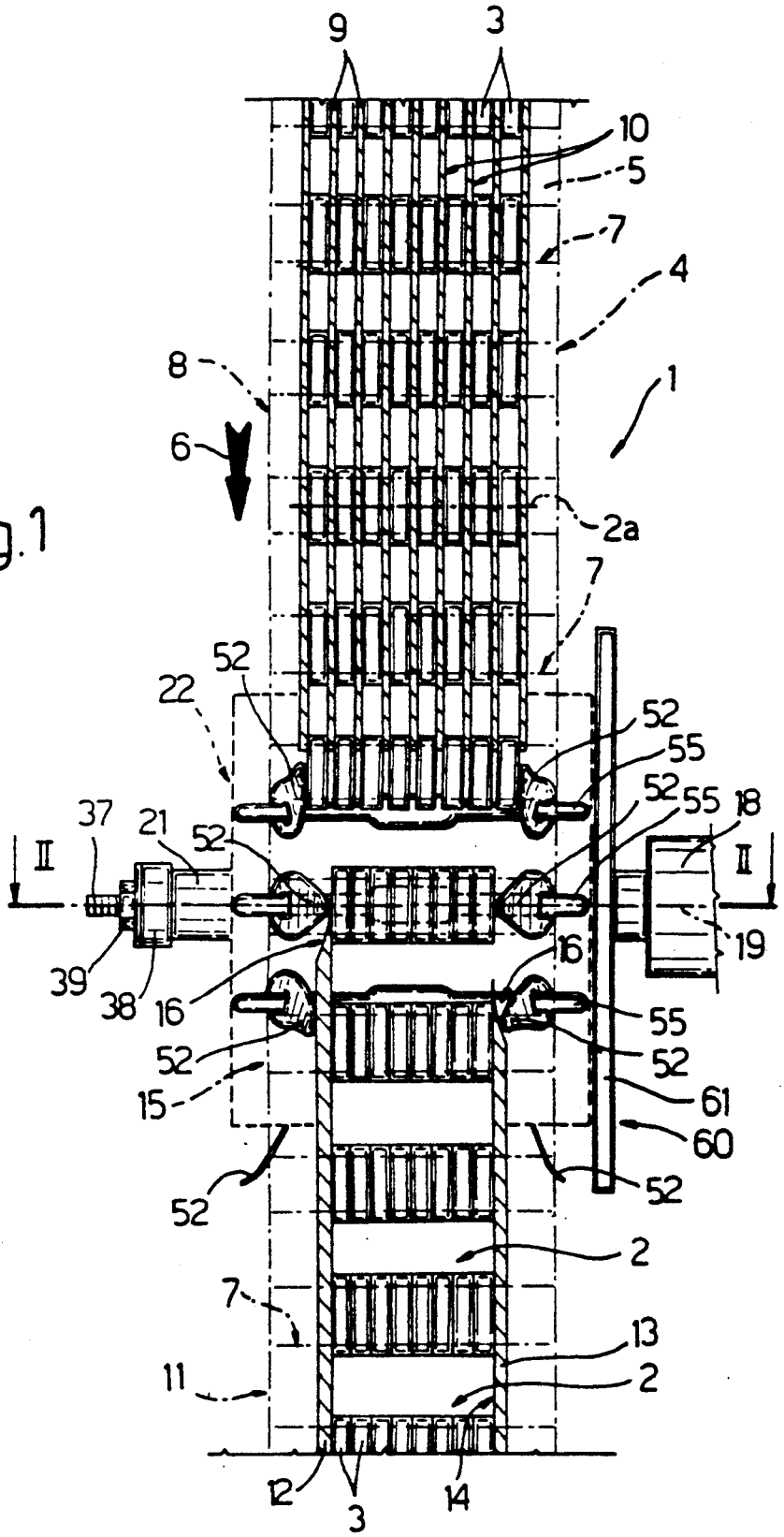
FIG. 1 shows a schematic, partially sectioned bottom view, with parts removed for clarity, of a preferred embodiment of the compacting unit according to the present invention.

With reference to FIG. 1, unit 1 comprises a through conveyor 4 having a branch 5 traveling at substantially constant speed in a substantially horizontal axial direction 6 and fitted on top with a number of pocket means consisting of grooves or recesses 7 extending perpendicular to direction 6 and each designed to receive a bottom portion of sweets 3 in a respective group 2 arranged side by side and on edge along a respective axis 2a perpendicular to direction 6.

Conveyor 4 comprises an input portion 8 along which branch 5 extends beneath a number of spacing means consisting of walls or rods 9 parallel to direction 6 and defining a number of longitudinal channels 10 equal to the number of sweets 3 in each group 2. Along input portion 8 of conveyor 4, each sweet 3 travels in direction 6 along respective channel 10 with its bottom portion engaged inside respective recess 7, and is maintained in a substantially vertical on-edge position, perpendicular to the surface of branch 5 and parallel to direction 6, by the two rods 9 defining channel 10 and by which it is separated from the adjacent sweets 3.

Conveyor 4 also comprises an output portion 11 along which branch 5 extends beneath two substantially vertical walls 12 and 13 extending parallel to direction 6 and defining a longitudinal channel 141, the width of which is approximately equal to but no smaller than the total thickness of sweets 3 in each group 2.

Conveyor 4 also comprises an intermediate portion 15 connecting input and output portions 8 and 11, and the length of which is substantially equal to twice the center distance of adjacent recesses 7.

As shown in FIG. 1, rods 9 all terminate at the start of portion 15, and walls 12 and 13 both present an outer bevel 16 and (for the reasons explained later on) commence respectively from the mid portion and close to the output of intermediate portion 15.

Figure 2:
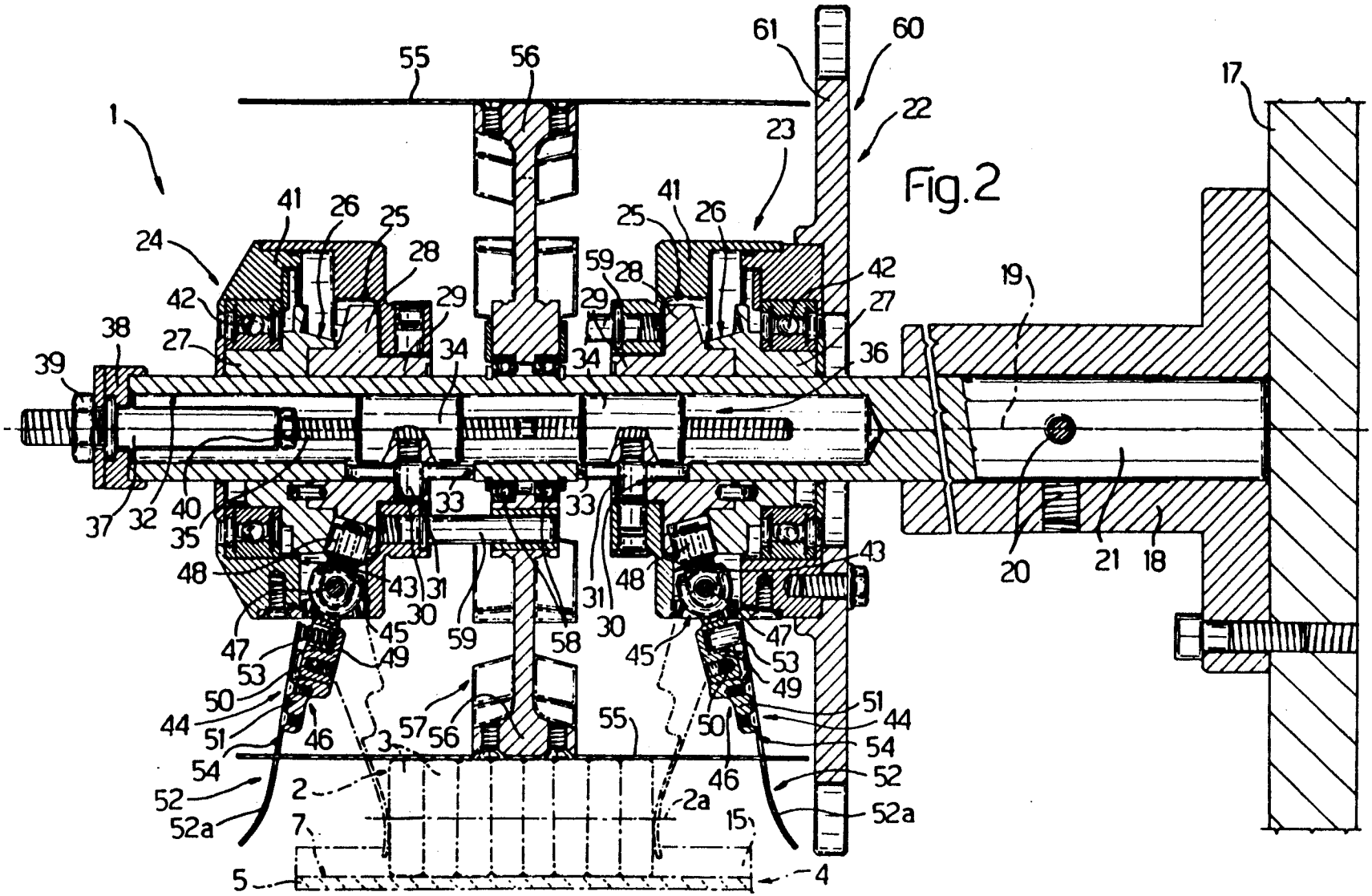
FIG. 2 shows a section along line II—II in FIG. 1.

As shown particularly in FIG. 2, unit 1 comprises a wall or frame 17 located to the side of conveyor 4 and parallel to walls 12 and 13, and fitted with a sleeve 18, the horizontal axis 19 of which extends over intermediate portion 15, perpendicular to direction 6. Sleeve 18 is fitted inside, by means of pins 20, with the end of a central shaft 21 supporting a compacting device 22 located over intermediate portion 15 of conveyor 4 and forming part of unit 1.

Device 22 comprises two annular bodies 23 and 24 fitted, coaxial with axis 19, to shaft 21 on either side of branch 5 and channel 14, and each comprising an annular drum type cam 25 having an outer groove 26 defined between two rings 27 and 28 connected integral with each other and constituting cam 25. Inner ring 28 presents an annular appendix 29 extending in contact with the outer surface of shaft 21 and having a radial through hole 30 engaged in sliding manner by the cylindrical head of a key element consisting of a threaded pin 31. Pin 31 engages in sliding manner an axial opening 33 in shaft 21, so as to penetrate radially inside an axial hole 32 in shaft 21, and is connected to a respective cylindrical slide 34 sliding along hole 32 in shaft 21.

Both slides 34 are fitted through with a screw 35 coaxial with axis 19, having two opposed threads, and by which slides 34 are locked mutually in an axially adjustable position. Together with screw 35, slides 34 form part of a device 36 for angularly locking cams 25 on shaft 21, and for adjusting the mutual position of annular bodies 23 and 24 along shaft 21. Device 36 also comprises a pin 37 having a threaded portion extending through a cap 38 closing hole 32, and fitted to cap 38 by means of a nut 39. Pin 37 also presents an internally threaded axial through hole (not shown) engaged by an end portion of screw 35, which is locked in an axially adjustable position in relation to pin 37 by means of a nut 40.

Each annular body 23, 24 comprises an outer sleeve 41 mounted for rotation on respective cam 25 via the interposition of a respective bearing 42, and having a number of radial openings 43, each engaged by a respective compacting arm 44 swinging radially in relation to shaft 21.

Each compacting arm 44 comprises a first and second rocker arm 45 and 46, the first extending through respective opening 43 and pivoting on a pin 47 extending transversely in relation to opening 43 and in a plane perpendicular to axis 19.

Each rocker arm 45 comprises a first arm consisting of a tappet 48 engaging groove 26 of respective cam 25 in sliding manner; and a second arm 49 extending outwards of sleeve 41 and supporting a pin 50 parallel to pin 47 and fitted through a central block 51 of rocker arm 46 so as to act as a pivot for the latter.

Each rocker arm 46 comprises an elastic blade 52 fitted centrally to respective block 51, having at one end an end portion 52a adjacent to the surface of branch 5 of conveyor 4, and fitted at the other end to arm 49 of respective rocker arm 45 via the interposition of a spring 53, which tends to rotate end portion 52a of blade 52 towards that of a corresponding blade 52 on the other of annular bodies 23, 24.

Blades 52 present respective central openings 54 aligned transversely in relation to direction 6 and engaged in sliding manner by the opposite ends of a plate 55 on the end of a respective arm 56 of a spoked wheel 57 mounted for rotation on shaft 21 via the interposition of two bearings 58, and located centrally between annular bodies 23 and 24. The diameter of wheel 57 is such that plates 55 travel over a cylindrical surface coaxial with axis 19 and which presents a minimum clearance in relation to branch 5 of conveyor 4 equal to the diameter of sweets 3 minus the depth of recesses 7.

Wheel 57 is fitted angularly integral with sleeves 41 by respective axial pins 59, and is rotated about axis 19 by a drive device 60, the output element of which consists of a gear 61 coaxial with axis 19 and connected integral with annular body 24. Gear 61 provides for driving plates 55 and consequently also end portions 52a of blades 52 at substantially the same speed as branch 5 in direction 6; and device 60 is timed in relation to conveyor 4 so that plate 55 substantially contacts the outer edge of a respective group 2 as this travels along intermediate portion 15 of conveyor 4.

Consequently, and as shown in FIG. 1, just before sweets 3 in group 2 leave respective channels 10, plate 55 is brought into flexible contact with the top edge of sweets 3 for maintaining them in the on-edge position on being detached from rods 9. At the same time, blades 52 of the two compacting arms 44 engaged by plate 55 are moved by cams 25 from the parted position shown by the continuous line in FIG. 2, wherein the distance between end portions 52a of blades 52 is greater than the axial dimension of groups 2 along input portion 8 of conveyor 4, into a position contacting the opposite ends of group 2. End portions 52a of blades 52 contact the axial ends of group 2 just before it leaves input portion 8 of conveyor 4, and continue to be brought together by cams 25, substantially along axis 2a of group 2, until they are eventually positioned as shown by the dotted line in FIG. 2, wherein springs 53 are compressed and blades 52 are flexed outwards with end portions 52a separated by a distance equal to the axial dimension of compacted group 2.

In other words, blades 52 provide for compacting group 2 as it travels along intermediate portion 15 of conveyor 4, and with substantially no sliding friction being applied on the end sweets 3 in group 2.

As shown in FIG. 1, blades 52 on each pair of arms 44 are not displaced in exactly the same manner, so that cams 25 differ at least as regards the angular position about axis 19. In fact, upon one end of compacted group 2 contacting the inner surface of wall 12, blade 52 on the wall 12 side begins to slide over outer bevel 16 on wall 12 into the parted position, thus enabling the other blade 52 to compact group 2 against the inner surface of wall 12; whereas blade 52 on the wall 13 side is not parted until later, i.e. upon the respective end of group 2 contacting the inner surface of wall 13. As such, blades 52 provide for ensuring group 2 is fed accurately inside channel 14.

We claim:

1. A unit (1) for compacting groups (2) of flat products (3) arranged side by side and on edge along a first axis (2*a*) perpendicular to the products (3); said unit (1) comprising conveyor means (4) for feeding said groups (2) successively and in a given traveling direction (6) perpendicular to said first axis (2*a*), and a compacting device (22) cooperating with said conveyor means (4); the conveyor means (4) comprising a number of pocket means (7), each designed to receive a respective said group (2) and feed it in said direction (6) at a given speed, a first and second portion (8, 15) arranged in series in said traveling direction (6), and spacing means (9) extending along said first portion (8) for maintaining the products (3) in each group (2) separated along the first axis (2*a*) and achieving a first given axial dimension of the group (2) greater than a second dimension equal to the total axial dimension of the relative products (3); characterized by the fact that the compacting device (22) cooperates with said second portion (15), and comprises a number of pairs of compacting elements (44) on either side of said second portion (15); drive means (60, 61) for moving each said pair of compacting elements (44) along said second portion (15) and substantially in time with a respective said pocket means (7); and guide means (25) connected to the compacting elements (44) in each said pair, for moving the compacting elements (44) in relation to each other, and in opposite directions, between a first and second position wherein the compacting elements (44) are separated by a distance respectively greater than said first axial dimension and substantially equal to said second axial dimension.

2. A unit as claimed in claim 1, characterized by the fact that each said compacting element (44) comprises an arm (44) mounted for rotation about a second axis (19) facing said second portion (15) and parallel to said first axis (2*a*); and first pivot means (47) extending transversely in relation to said first and second axis (2*a*, 19) and rotating with said arm (44) about the second axis (19); said guide means (25) being connected to said arm (44) so as to swing it about said first pivot means (47) and move it between said first and second position.

3. A unit as claimed in claim 3, characterized by the fact that each said arm (44) is an articulated swing arm, and comprises a first (45) and second (46) portion, and second pivot means (50) located between the first (45) and second (46) portion and extending transversely in relation to said first and second axis (2*a*, 19); said first portion (45) being connected to both said first pivot means (47) and said guide means (25), for swinging the arm (44) about said first pivot means (47).

4. A unit as claimed in claim 3, characterized by the fact that the compacting device (22) comprises two supporting elements (41) mounted for rotation about said second axis (19) and located on either side of said conveyor means (4); each supporting element (41) being fitted with a number of said first pivot means (47), and being connected to said drive means (60, 61) for driving the second portion (46) of each respective swing arm (44) at a surface speed substantially equal to the traveling speed of said conveyor means (4).

5. A unit as claimed in claim 4, characterized by the fact that said first and second portion (45, 46) respectively comprise a first (45) and second (46) rocker arm; the first rocker arm (45) being connected to the respective supporting element (41) via said first pivot means (47); the second rocker arm (46) being connected to the first rocker arm (45) via said second pivot means (50) and being rotated in relation to the first rocker arm (46) and away from said conveyor means (4) against the action of elastic means (53) located between one arm of the second rocker arm (46) and one arm (49) of the first rocker arm (45); a further arm (48) of the first rocker arm (45) engaging said guide means (25).

6. A unit as claimed in claim 5, characterized by the fact that said second rocker arm (46) comprises a further arm defined by an end portion (52*a*) of an elastic blade (52) designed, in said second position, to contact a respective said group (2).

7. A unit as claimed in claim 6, characterized by the fact that it also comprises a spoked wheel (57) located between said two supporting elements (41) and rotating with the supporting elements about said second axis (19); the spoked wheel (57) comprising a number of radial arms (56); and a plate (55) being fitted to each said radial arm (56) and being located between two said compacting arms (44) so as to cooperate laterally with a respective said group (2) in said second portion (15) of said conveyor means (4).

* * * * *

UNITED STATES PATENT AND TRADEMARK OFFICE

CERTIFICATE OF CORRECTION

PATENT NO. : 5,251,740

DATED : October 12, 1993

INVENTOR(S) : Mario Spatafora et al.

It is certified that error appears in the above-indentified patent and that said Letters Patent is hereby corrected as shown below:

On the title page, Item [73],

The assignee should read: --Azionaria Costruzioni Macchine Automatiche A.C.M.A. S.p.A., Bologna, Italy--

Signed and Sealed this

Third Day of May, 1994

Bruce Lehman

*Attest:*

BRUCE LEHMAN

*Attesting Officer*

*Commissioner of Patents and Trademarks*